US005540366A

United States Patent [19]

Coomber

[11] Patent Number: 5,540,366

[45] Date of Patent: Jul. 30, 1996

[54] WATERPROOF MONEY BELT

[76] Inventor: Curtiss Coomber, 36 Hodges Bay, Regina, Saskatchewan, Canada, S4N 4R1

[21] Appl. No.: 499,218

[22] Filed: Jul. 7, 1995

[51] Int. Cl.[6] ..... A45F 3/00

[52] U.S. Cl. ..... 224/677; 383/59; 383/61; 383/69; 383/85; 224/587

[58] Field of Search ..... 224/224, 226, 224/228, 219, 222, 167; 150/101, 118, 119, 120; 383/59, 61, 63, 85

[56] References Cited

U.S. PATENT DOCUMENTS 2,039,887 5/1936 Colletti ..... 150/118
5,048,692 9/1991 Handler et al. ..... 383/63

FOREIGN PATENT DOCUMENTS 2241149 8/1991 United Kingdom ..... A41F 9/00

*Primary Examiner*—David J. Walczak
*Attorney, Agent, or Firm*—Anthony R. Lambert

[57] ABSTRACT

A waterproof money belt characterized by an access opening in the pouch having a first sidewall and a second sidewall. A first peripheral edge of the first sidewall extends past a second peripheral edge of the second sidewall such that a flap portion is formed adjacent the first peripheral edge. The flap portion of the first sidewall is movable between a position parallel to the second sidewall and a folded position in which the first sidewall overlies the second sidewall, Mating ZIPLOC closures are used to secure the first sidewall and second sidewall together, A first tape fastener is positioned adjacent a first peripheral edge on a first interior surface of the flap portion of the first sidewall. A second tape fastener is positioned adjacent a second peripheral edge on a second exterior surface of the second sidewall. The first tape fastener engages the second tape fastener when the flap portion of the first sidewall is in the folded position. A third tape fastener is positioned adjacent the first peripheral edge on the first exterior surface of the flap portion of the first sidewall. A fourth tape fastener is positioned on the second exterior surface of the second sidewall spaced from the second peripheral edge. When the flap portion of the first sidewall is in the folded position, the first sidewall and the second sidewall are foldable over together until the third tape fastener engages the fourth tape fastener.

5 Claims, 5 Drawing Sheets

WATERPROOF MONEY BELT

FIELD OF THE INVENTION

The present invention relates to a waterproof money belt.

BACKGROUND OF THE INVENTION

Money belts have previously been developed that purport to be "waterproof" or "watertight". One example of such a money belt is United Kingdom Patent Application 2,241,149 filed by Lucas et al which was published under the rules of the United Kingdom Patent Office in 1991. The Lucas et al reference discloses a pouch attached to a belt. The pouch has an opening that is sealed by a waterproof fastener. The waterproof fastener is neither illustrated nor described.

The Lucas et al patent application treats the sealing of the opening in the pouch by means of a waterproof fastener, as if adequate waterproof fasteners were well known in the art. However, a problem commonly encountered with money belts that purport to be waterproof is that leakage into the pouch occurs through the opening in the pouch past the "waterproof" fastener.

SUMMARY OF THE INVENTION

What is required is a waterproof money belt with an improved form of water proof closure.

According to the present invention there is provided a waterproof money belt. The waterproof money belt has a pouch made of a waterproof material with a belt secured to the pouch. The waterproof money belt is characterized by an access opening in the pouch including a first sidewall and a second sidewall in parallel face to face relation. The first sidewall has a first peripheral edge, a first interior surface and a first exterior surface. The second sidewall has a second peripheral edge, a second interior surface and a second exterior surface. The first peripheral edge of the first sidewall extends past the second peripheral edge of the second sidewall such that a flap portion is formed adjacent the first peripheral edge. The flap portion of the first sidewall is movable between a position parallel to the second sidewall and a folded position in which the first interior surface of the first sidewall overlies the second exterior surface of the second sidewall. A waterproof closure for the access opening into the pouch is provided. This waterproof closure includes a first ZIPLOC closure on the first interior surface and a second ZIPLOC closure on the second interior surface. The second ZIPLOC closure mates with the first ZIPLOC closure. It is noted that a typical ZIPLOC closure comprises a male strip member which is received within a female strip member. A first tape fastener is positioned adjacent the first peripheral edge on the first interior surface of the flap portion of the first sidewall. A second tape fastener is positioned adjacent the second peripheral edge on the second exterior surface of the second sidewall. The first tape fastener engages the second tape fastener when the flap portion of the first sidewall is in the folded position. A third tape fastener is positioned adjacent the first peripheral edge on the first exterior surface of the flap portion of the first sidewall. A fourth tape fastener is positioned on the second exterior surface of the second sidewall spaced from the second peripheral edge. When the flap portion of the first sidewall is in the folded position, the first sidewall and the second sidewall are foldable over together until the third tape fastener engages the fourth tape fastener.

The money belt, as described above, is much more effective in preventing the entry of water through the access opening into the pouch. In addition to the provision of a waterproof ZIPLOC closure between the sidewalls, the ability to resist the entry of water is enhanced by the use of a double fold; the first fold being the folded position of the flap portion of the first sidewall and the second fold being the folding together of the first sidewall and the second sidewall. The folds are maintained and made further leak resistant by the provision of the tape fasteners. The first fold being maintained by the first tape fastener mating with the second tape fastener. The second fold being maintained by the third tape fastener mating with the fourth tape fastener.

Although beneficial results may be obtained through the use of the waterproof money belt, as described above, there are two further refinements which are preferred. It is preferred that a double ZIPLOC system be used having a first pair of zip-locks that mates with a second pair of parallel ZIPLOCS. It is also preferred that the second peripheral edge is folded over when the flap portion of the first sidewall is positioned in the folded position. The folding over the second peripheral edge helps resist leakage when the flap portion of the first sidewall is in the folded position.

Although beneficial results may be obtained through the use of a waterproof money belt, as described above, a further problem encountered with money belts of this type is that of comfort for the user. Materials that are waterproof do not breathe and as such are not very comfortable when positioned directly against the skin of the user. Even more beneficial results may, therefore, be obtained when a nylon mesh backing layer overlies a portion of the first exterior surface of the first sidewall. The nylon mesh backing layer rests against a persons skin when the money belt is worn. A suitable nylon mesh backing is sold under the trademark "cambrelle". It is comparatively soft and provides access to air. This results in the money belt being comfortable to wear, whether wet or dry. The nylon mesh backing layer can be heat sealed along its seams to the first sidewall and the second sidewall during fabrication of the pouch.

In summary, the waterproof pouch constructed in accordance with the teaching of the present invention is capable of being fully submerged without leaking, and at the same time is more comfortable to wear.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
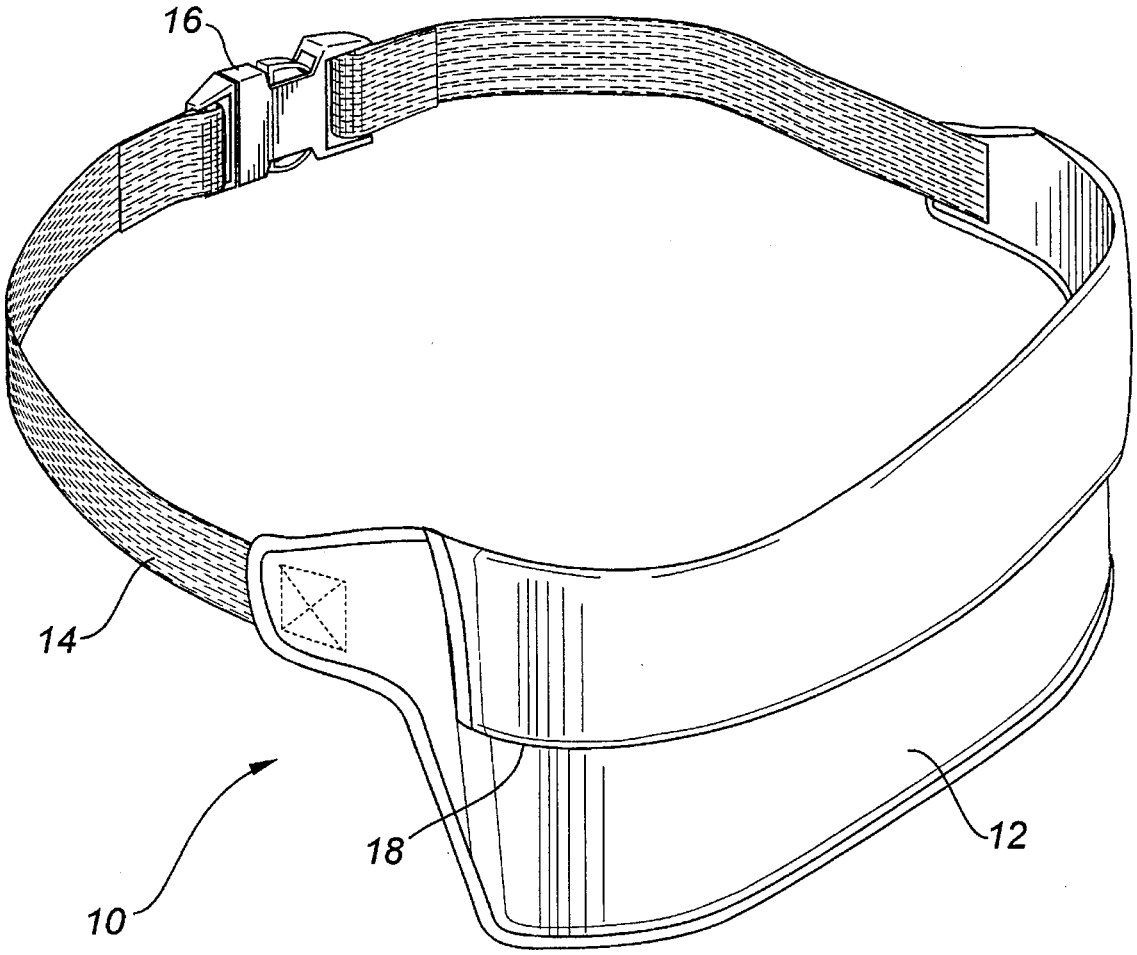
FIG. 1 is a perspective view of a waterproof money belt constructed in accordance with the teachings of the present invention.

The preferred embodiment, a waterproof money belt generally identified by reference numeral 10, will now be described with reference to FIGS. 1 through 8.

Figure 6:
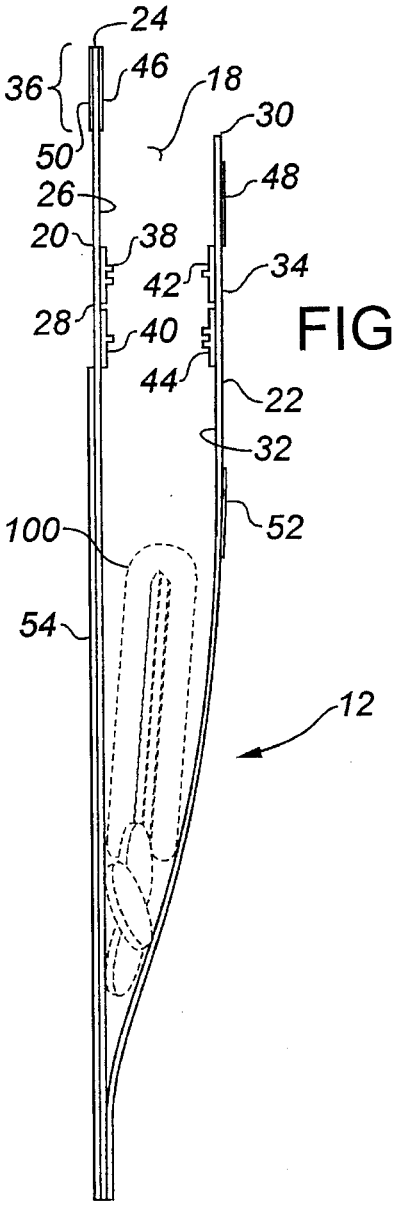
FIG. 6 is a side elevation view in section of the waterproof money belt illustrated in FIG. 2.
Figure 7:
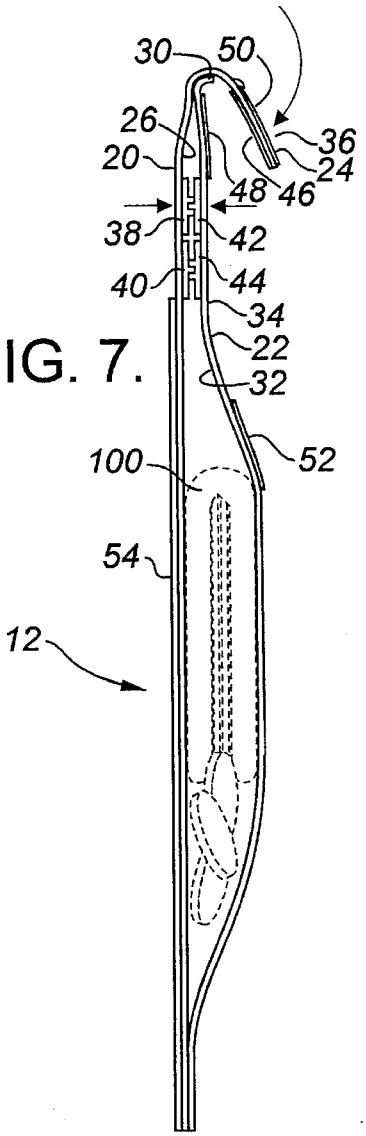
FIG. 7 is a side elevation view in section of the waterproof money belt illustrated in FIG. 3.
Figure 8:
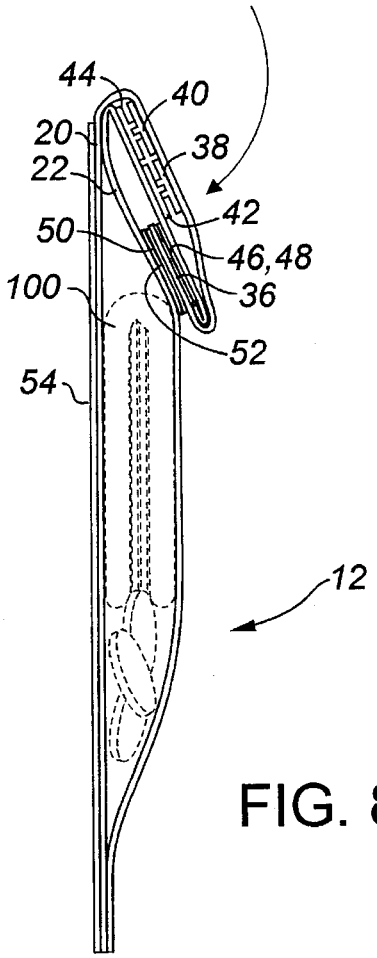
FIG. 8 is a side elevation view in section of the waterproof money belt illustrated in FIG. 4.

Referring to FIG. 1, waterproof money belt 10 consists of a pouch 12 made of a waterproof material with a belt 14 secured to pouch 12. Belt 14 has a buckle 16, to facilitate attachment of belt 14 to a torso of a person. Pouch 12 has an access opening 18. Referring to FIG. 6, access opening 18 is created by a first sidewall 20 and a second sidewall 22 in parallel face to face relation. First sidewall 20 has a first peripheral edge 24, a first interior surface 26 and a first exterior surface 28. Second sidewall 22 has a second peripheral edge 30, a second interior surface 32 and a second exterior surface 34. First peripheral edge 24 of first sidewall 20 extends past second peripheral edge 30 of second sidewall 22, such that a flap portion 36 is formed adjacent first peripheral edge 24. Flap portion 36 of first sidewall 20 is movable between a position parallel to second sidewall 22, as illustrated in FIG. 6, and a folded position in which first interior surface 26 of first sidewall 20 overlies second exterior surface 34 of second sidewall 22, as illustrated in FIG. 7. It is to be noted that second peripheral edge 30 is folded over when flap portion 36 of first sidewall 20 is positioned in the folded position illustrated in FIG. 7. Referring to FIG. 6, the waterproof closure for access opening 18 into pouch 12 includes a first pair of parallel zip-lock closures 38 and 40 on first interior surface 26 and a second pair of parallel ZIPLOC closures 42 and 44 on second interior surface 32. Referring to FIG. 7, second pair of parallel ZIPLOC closures 42 and 44 mate with first pair of parallel ZIPLOC closures 38 and 40. Referring to FIG. 6, a first tape fastener 46 is positioned adjacent first peripheral edge 24 on first interior surface 26 of flap portion 36 of first sidewall 20. A second tape fastener 48 is positioned adjacent second peripheral edge 30 on second exterior surface 34 of second sidewall 22. Referring to FIG. 7, first tape fastener 46 engages second tape fastener 48 when flap portion 36 of first sidewall 20 is in the folded position. Referring to FIG. 6, a third tape fastener 50 is positioned adjacent first peripheral edge 24 on first exterior surface 28 of flap portion 36 of first sidewall 20. A fourth tape fastener 52 is positioned on second exterior surface 34 of second sidewall 22 spaced from second peripheral edge 30. Referring to FIG. 8, when flap portion 36 of first sidewall 20 is in the folded position, first sidewall 20 and second sidewall 22 are foldable over together until third tape fastener 50 engages fourth tape fastener 52. Referring to FIG. 6, a nylon mesh backing layer 54 overlies a lower portion of first exterior surface 28 of first sidewall 20. The inter-relationship of nylon mesh backing layer 54 with first sidewall 20 and second sidewall 22 is further illustrated in FIG. 5. The layers are fastened together by heat sealing along their peripheral edges. ZIPLOC fasteners 38, 40, 42, and 44 are similarly affixed by means of heat sealing.

Figure 2:
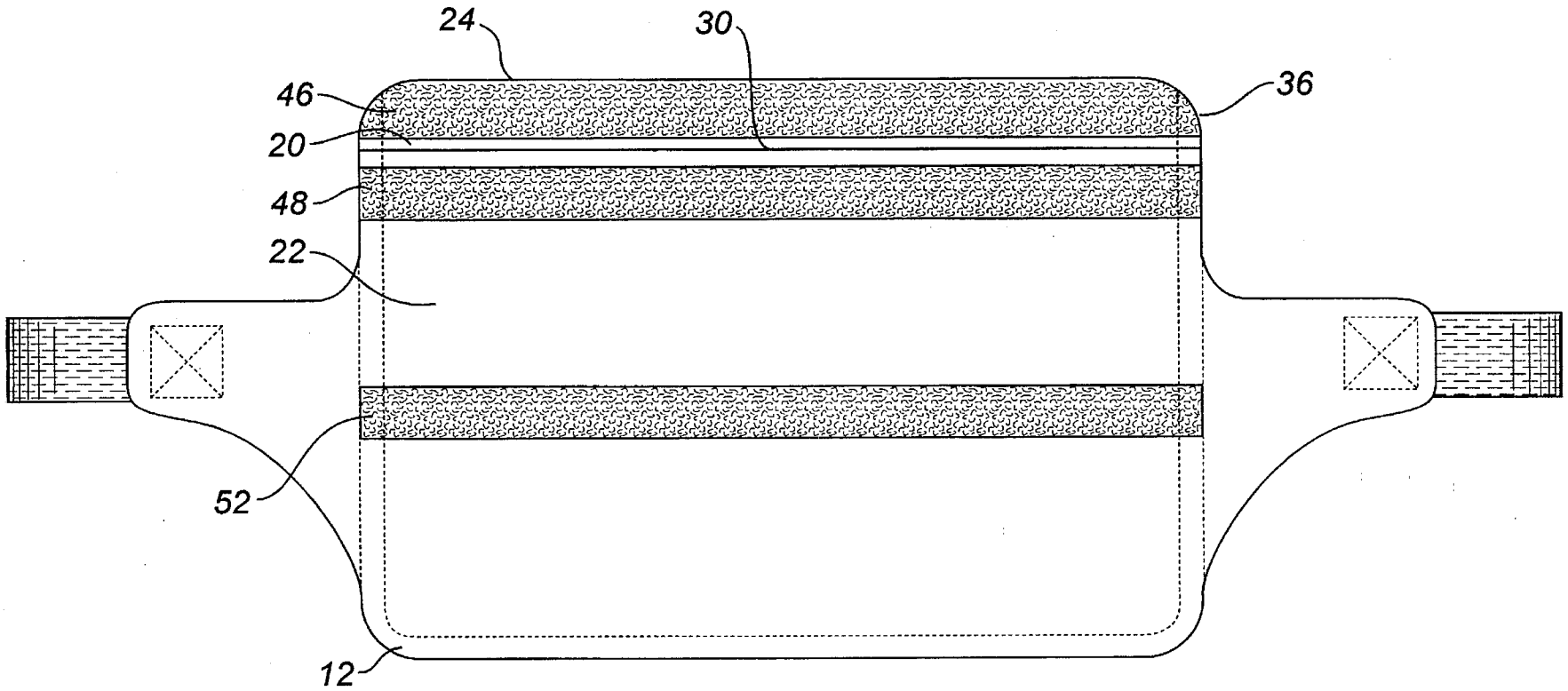
FIG. 2 is a front elevation view of the waterproof money belt illustrated in FIG. 1, in a fully open condition.
Figure 3:
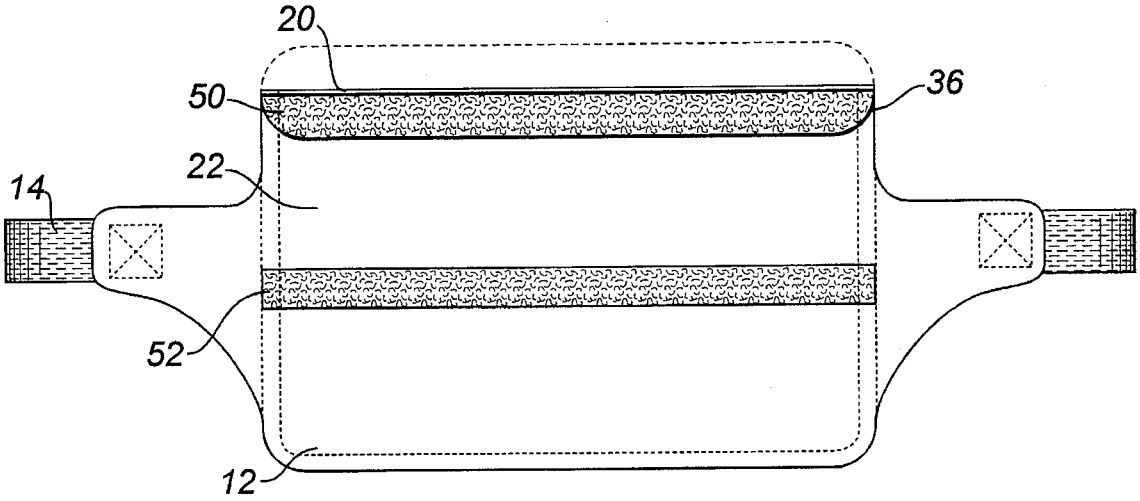
FIG. 3 is a front elevation view of the waterproof money belt illustrated in FIG. 1, with the flap portion of the first sidewall in a folded position.
Figure 4:
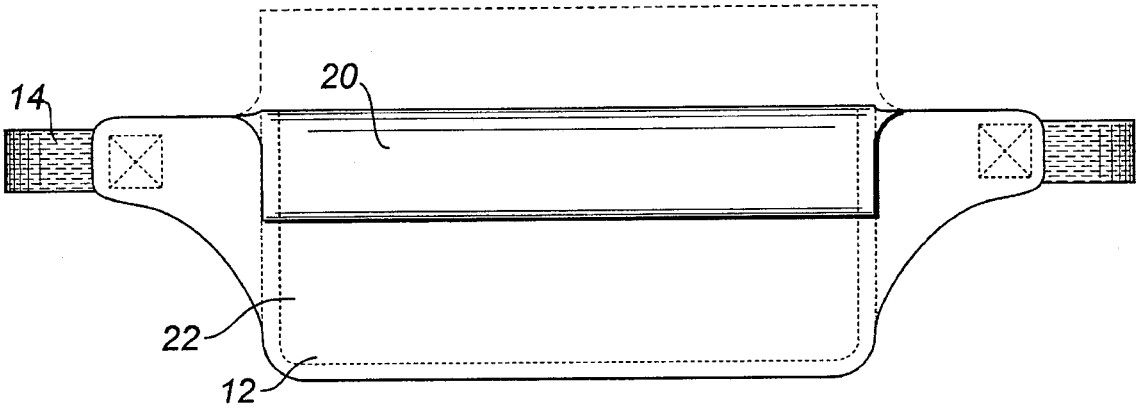
FIG. 4 is a front elevation view of the waterproof money belt illustrated in FIG. 1, with the first sidewall and the second sidewall folded together.
Figure 5:
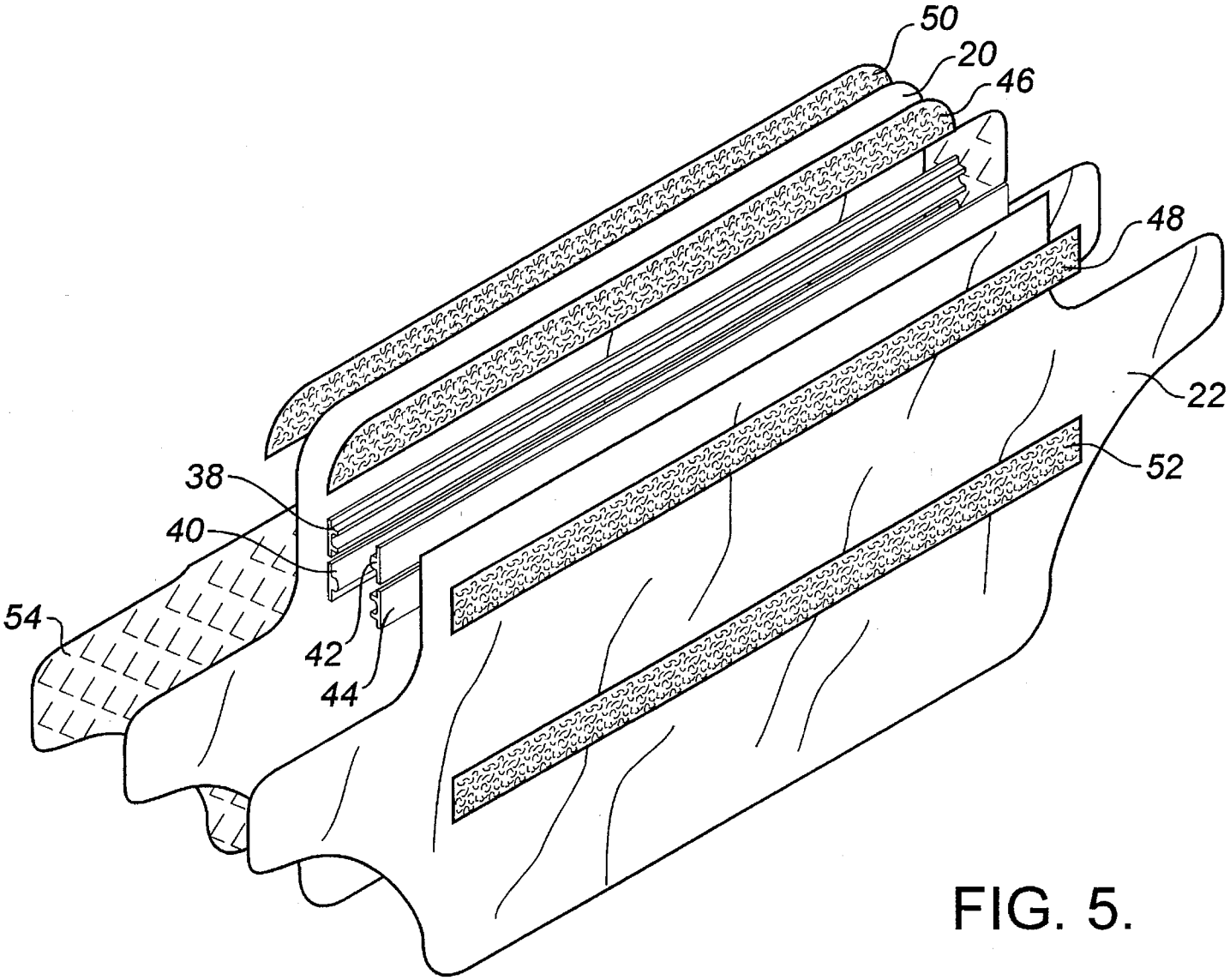
FIG. 5 is an exploded perspective view of the waterproof money belt illustrated in FIG. 2.

The use and operation of waterproof money belt 10 will now be described with reference to FIGS. 1 through 8. Waterproof money belt 10 is secured around a persons torso by means of buckles 16 on belt 14. When access opening 18 is open, waterproof money belt 10 appears as illustrated in FIG. 2. A wallet 100 may then be inserted through access opening, as illustrated in FIG. 6. Once wallet 100 is in position, first pair of ZIPLOC fasteners 38 and 40 are mated with second pair of ZIPLOC fasteners 42 and 44, respectively, as illustrated in FIG. 7. Flap portion 36 of first sidewall 20, is then placed in the folded position, illustrated in FIG. 7, with first tape fastener 46 mated with second tape fastener 48. FIG. 3 depicts the external appearance of waterproof money belt 10 when first tape fastener 46 is mated with second tape fastener 48. Referring to FIG. 7, it should be noted that second peripheral edge 30 is partially folded over to prevent any water from passing past that first fold. Referring to FIG. 8, first sidewall 20 and second sidewall 22 are then folded over together until third tape fastener 50 engages fourth tape fastener 52. FIG. 4 depicts the external appearance of waterproof money belt 10 when third tape fastener 50 is engaged with fourth tape fastener 52. FIG. 1, depicts waterproof money belt 10 once these steps have been completed.

It will be apparent to one skilled in the art from a review of the drawings and above description, the multiple barriers that water must penetrate in order to pass through access opening 18. A first barrier is the contact area where third tape fastener 50 engages fourth tape fastener 52. A second barrier is where first sidewall 20 and second sidewall 22 are folded together. A third barrier is the contact area where first tape fastener 46 engages second tape fastener 48. A fourth barrier is where flap portion 36 of first sidewall 20 is folded, including the folding over of second peripheral edge 30. A fourth barrier is where ZIPLOC 38 of the first pair of ZIPLOCS engages ZIPLOC 42 of the second pair of ZIPLOCS. A fifth barrier is where ZIPLOC 40 of the first pair of ZIPLOCS engages ZIPLOC 44 of the second pair of ZIPLOCS. It will also be apparent to one skilled in the art the additional comfort that nylon mesh backing layer 54 provides. It will finally be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A waterproof money belt having a pouch made of a waterproof material with a belt secured to the pouch, characterized by:

an access opening in the pouch including a first sidewall and a second sidewall in parallel face to face relation, the first sidewall having a first peripheral edge, a first interior surface and a first exterior surface, the second sidewall having a second peripheral edge, a second interior surface and a second exterior surface, the first peripheral edge of the first sidewall extending past the second peripheral edge of the second sidewall such that a flap portion having a flap portion first interior surface and a flap portion first exterior surface is formed adjacent the first peripheral edge, the flap portion of the first sidewall being movable between a position parallel to the second sidewall and a folded position in which the first interior surface of the first sidewall overlies the second exterior surface of the second sidewall;

a waterproof closure for the access opening into the pouch including:

a first closure on the first interior surface, a second closure on the second interior surface, the second closure mating with the first closure;

a first tape fastener adjacent the first peripheral edge on the first interior surface of the flap portion of the first sidewall, a second tape fastener adjacent the second peripheral edge on the second exterior surface of the second sidewall, such that the first tape fastener engages the second tape fastener when the flap portion of the first sidewall is in the folded position; and a third tape fastener adjacent the first peripheral edge on the first exterior surface of the flap portion of the first sidewall, a fourth tape fastener on the second exterior surface of the second sidewall spaced from the second peripheral edge, such that when the flap portion of the first sidewall is in the folded position the first sidewall and the second sidewall are foldable over together until the third tape fastener engages the fourth tape fastener.

2. The waterproof money belt as defined in claim 1, wherein the second peripheral edge is folded over when the flap portion of the first sidewall is positioned in the folded position.

3. The waterproof money belt as defined in claim 1, wherein the first closure is paired with another parallel closure and the second closures is paired with another parallel closure.

4. The waterproof money belt as defined in claim 1, wherein a nylon mesh backing layer overlies a portion of the first exterior surface of the first sidewall.

5. A waterproof money belt having a pouch made of a waterproof material with a belt secured to the pouch, characterized by:

an access opening in the pouch including a first sidewall and a second sidewall in parallel face to face relation, the first sidewall having a first peripheral edge, a first interior surface and a first exterior surface, the second sidewall having a second peripheral edge, a second interior surface and a second exterior surface, the first peripheral edge of the first sidewall extending past the second peripheral edge of the second sidewall such that a flap portion having a flap portion first interior surface and a flap portion first exterior surface is formed adjacent the first peripheral edge, the flap portion of the first sidewall being movable between a position parallel to the second sidewall and a folded position in which the first interior surface of the first sidewall overlies the second exterior surface of the second sidewall, the second peripheral edge being folded over when the flap portion of the first sidewall is positioned in the folded position;

a waterproof closure for the access opening into the pouch including:

a first pair of parallel closures on the first interior surface, a second pair of parallel closures on the second interior surface, the second pair of parallel closures mating with the first pair of parallel closures;

a first tape fastener adjacent the first peripheral edge on the first interior surface of the flap portion of the first sidewall, a second tape fastener adjacent the second peripheral edge on the second exterior surface of the second sidewall, such that the first tape fastener engages the second tape fastener when the flap portion of the first sidewall is in the folded position;

a third tape fastener adjacent the first peripheral edge on the first exterior surface of the flap portion of the first sidewall, a fourth tape fastener on the second exterior surface of the second sidewall spaced from the second peripheral edge, such that when the flap portion of the first sidewall is in the folded position the first sidewall and the second sidewall are foldable over together until the third tape fastener engages the fourth tape fastener; and a nylon mesh backing layer overlying a portion of the first exterior surface of the first sidewall.

* * * * *